US005358653A

United States Patent [19]

Gladfelter et al.

[11] Patent Number: 5,358,653

[45] Date of Patent: Oct. 25, 1994

[54] CHLORINATED SOLID RINSE AID

[75] Inventors: Elizabeth J. Gladfelter, Falcon Heights; James L. Copeland, Burnsville; Stephen A. Morganson, Eagan; Keith Olson, Apple Valley, all of Minn.

[73] Assignee: Ecolab, Inc., St. Paul, Minn.

[21] Appl. No.: 543,211

[22] Filed: Jun. 25, 1990

[51] Int. Cl.[5] ..... B08B 9/28; C11D 1/72; C11D 3/395; C11D 17/00

[52] U.S. Cl. ..... 252/90; 134/25.2; 134/26; 252/95; 252/99; 252/102; 252/174; 252/174.13; 252/174.15; 252/174.16; 252/174.17; 252/174.21; 252/174.22; 252/186.35; 252/358; 252/DIG. 1; 252/DIG. 10; 252/DIG. 11; 252/DIG.16; 252/DIG. 17

[58] Field of Search ..... 252/95, 99, 100, 101, 252/174, 174.15, 174.25, 186–186.35

[56] References Cited

U.S. PATENT DOCUMENTS

| | | | |
|---|---|---|---|
| 3,272,899 | 9/1966 | Diamond et al. | 264/126 |
| 3,329,615 | 7/1967 | Cooper et al. | 252/99 |
| 3,444,242 | 5/1969 | Rue et al. | 260/611 |
| 3,580,850 | 5/1971 | Dupre | 252/99 |
| 3,592,774 | 7/1971 | Altenschopfer | 252/89 |
| 3,858,854 | 1/1975 | Win et al. | 252/174.12 |
| 3,944,497 | 3/1976 | Alterman et al. | 252/96 |
| 3,960,781 | 6/1976 | Freis et al. | 252/541 |
| 4,024,257 | 5/1977 | Kibbel, Jr. | 424/249 |
| 4,136,052 | 1/1979 | Mazzola | 252/94 |
| 4,162,987 | 7/1979 | Maguire, Jr. et al. | 252/174.12 |
| 4,219,435 | 8/1980 | Biard et al. | 252/174 |
| 4,219,436 | 8/1980 | Gromer et al. | 252/174 |
| 4,253,842 | 3/1981 | Ehrlich | 252/93 |
| 4,285,352 | 8/1981 | McMahon et al. | 134/48 |
| 4,411,810 | 10/1983 | Dutton et al. | 252/99 |
| 4,460,490 | 7/1984 | Barford et al. | 252/92 |
| 4,517,166 | 5/1985 | Busacca | 423/474 |
| 4,545,917 | 10/1985 | Smith et al. | 252/90 |
| 4,594,175 | 6/1986 | Copeland | 252/99 |
| 4,595,520 | 6/1986 | Heile et al. | 252/99 |
| 4,680,134 | 7/1987 | Heile et al. | 252/99 |
| 4,681,914 | 7/1987 | Olson et al. | 252/91 |
| 4,692,335 | 9/1987 | Iwanski | 424/149 |
| 4,711,738 | 12/1987 | Copeland | 252/95 |
| 4,731,195 | 3/1988 | Olson | 252/174.13 |
| 4,756,844 | 7/1988 | Walles et al. | 252/95 |
| 4,762,637 | 8/1988 | Aronson et al. | 252/174.24 |
| 4,793,942 | 12/1988 | Lokkesmoe et al. | 252/99 |
| 4,830,773 | 5/1989 | Olson | 252/99 |
| 4,846,993 | 6/1989 | Lentsch et al. | 252/174.24 |
| 4,863,632 | 9/1989 | Aronson et al. | 252/186.34 |
| 4,919,841 | 4/1990 | Kamel et al. | 252/174.13 |
| 4,933,102 | 6/1990 | Olson | 252/174 |

OTHER PUBLICATIONS

Parker and Schoene, "Formulating Home and Institutional Rinse Aids", *HAPPI*, Jan., 1988, pp. 83, 86.

Zini, "Non-ionic Surfactants and Anionic Polymers for Improved Hard Surface Rinsing Characteristics", *Il Prodotto Chimico*, Sep. 1988, pp. 26–27, 30–31.

Dibello, Fuchs and Carfagno, "Bleach Additives for Detergent Systems", *Soap/Cosmetics/Chemical Specialties*, Aug., 1974, pp. 46, 48–50, 52, 54–55.

"OCI TM 56" Product Data sheet (Olin Chemicals), 1981, (no month available).

"Chloroisocyanurates for Bleaches, Sanitizers, and Cleaning Compounds", Application Data sheet (Olin), 1982, (no month available).

Olin Material Safety Data Sheet, MSDS File 1529, Dec., 1988.

U.S. Ser. No. 07/331,695, filed Mar. 31, 1989 to Olson et al.

*Primary Examiner*—Paul Lieberman
*Assistant Examiner*—Wm. S. Parks
*Attorney, Agent, or Firm*—Merchant, Gould, Smith, Edell, Welter & Schmidt

[57] ABSTRACT

The invention relates to rinse aid compositions useful in warewashing, that provide sanitizing properties and stain control. The rinse aids of the invention provide a highly active available chlorine source which is incorporated into solid systems containing sheeting agents. The chlorine source is sufficiently stable to permit manufacture, storage, distribution, sale and consumption without loss of substantial proportions of active chlorine, while allowing for a broad selection of surfactants.

52 Claims, 1 Drawing Sheet

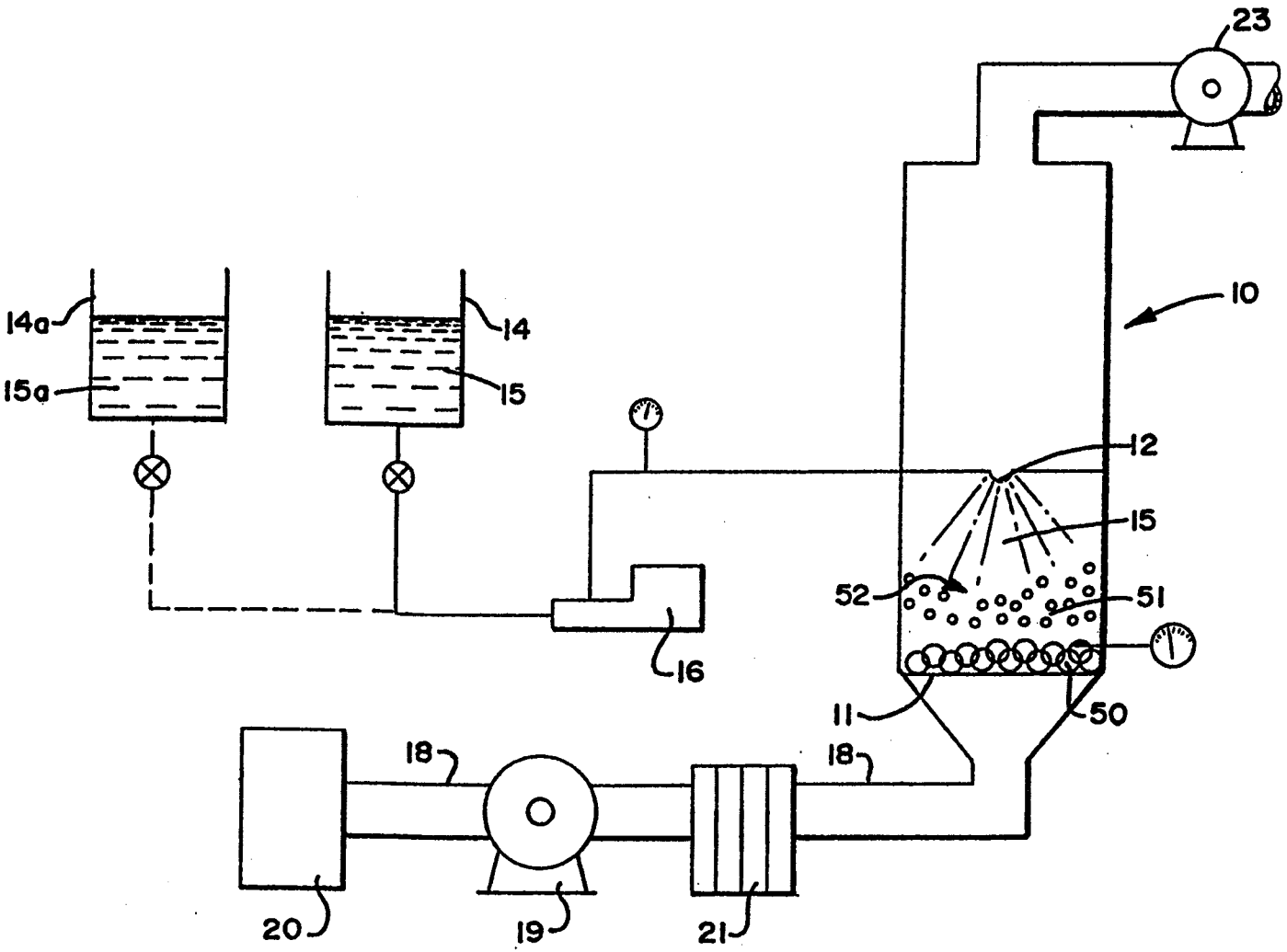
23
10
12
15
51
50
52
11
18
21
16
19
14
15
18
20
14a
15a

CHLORINATED SOLID RINSE AID

FIELD OF THE INVENTION

The invention relates to a stable cast solid chlorinated rinse aid concentrate. The concentrate contains surfactants capable of reducing the surface tension of aqueous rinse solutions and promoting a sheeting action. The concentrate also contains a stable active chlorine source that can act to both remove stains and to sanitize surfaces.

BACKGROUND OF THE INVENTION

Rinse agents have been used in household and institutional warewashing for many years. Commonly rinse aids provide an effective amount of a sheeting agent or rinse aid to ensure that the surface tension of the aqueous rinse is reduced and sheeting is promoted to prevent the formation of water beads that can dry into water spots and streaks. Nonionic surfactants used in conventional rinse aids are polyalkylene oxide polymers made from ethylene oxide and propylene oxide, (block or heteric polymers thereof). For example, Altenschopher, U.S. Pat. No. 3,592,774 issued Jul. 13, 1971 discloses a rinse aid concentrate which may be dispensed during a rinse cycle by automatic dosing. Optionally, the concentrate may also contain anionic surfactant or a water soluble organic solvent. J. Diamond et al, U.S. Pat. No. 3,272,899 discloses a solid block pellet or bar of wetting agent which may be positioned in a stream of rinse water to provide a gradual dissolution of the wetting agent into the rinse. The solid wetting agent can contain a nonionic surfactant and 3–20% of an alkyl substituted amide. Smith et al, U.S. Pat. No. 4,545,917 discloses a water soluble solid composition useful in rinsing comprising one or more polyethylene glycol having a molecular weight of at least 4,000 and a nonionic surfactant composed of a $C_{8-18}$ ethoxylated straight chain alcohol, a solid $C_{10-24}$ fatty acid alkanol amide and a nonionic amine of polyglycol condensate.

Solid rinse aids are available for household and institutional warewashing. In household machines, rinse aids are generally packaged in a container or basket introduced into the internal washing compartment of a machine. Water used in the rinse cycle dissolves portions of the rinse aid which enters the rinse water. Institutional machines are generally either low temperature machines (water temperature 120°–140° F.) or high temperature machines (temperature 160°–180° F.). Low temperature machines can avoid high costs associated with heating water and are often more convenient for dispensing rinse aids into a machine sump. In high temperature systems, dissolved rinse aid is often injected into a rinse water line prior to entering the machine through a stationary or rotary spray arm. A continuous stream of hot water is commonly provided through the spray arm for rinsing. Consequently, a rinse aid for use at high temperature systems must be dispensed into and sufficiently dissolved in the hot water system to permit successful injection of the material into a high temperature spray arm. Such high temperature machines are generally more complex and high volume.

The wetting or sheeting agents used in the invention should be soluble or capable of being solubilized. Useful concentrations of the material should produce little or no foam, even in the presence of compositions, such as residual protein, that generate foam. Lastly, the agent should reduce surface tension and promote sheeting and drainage of rinse water off the ware. In addition to the need for low foaming, soluble surfactants providing anti-spotting or sheeting action, a need has arisen in the art for providing rinse compositions which can provide an effective stable source of active halogen such as chlorine.

In the past, the active chlorine has been incorporated directly into warewashing detergent formulations. However, the detergent environment reduces the effectiveness of the chlorine as a bleach or sanitizer and requires the use of large amounts of halogen for effective action. The pH of washing tanks using alkaline detergents is different than the optimum neutral pH range for bleaching. Further, the temperature in washing tanks is generally 20°–40° lower than optimal rinsing temperatures. The rate of bleaching reactions increases with increasing temperature and, all things being equal, chlorine is more active at high temperature. Lastly, the amount of organic soil load in the washing cycle is substantial. Chlorine attacks any organic species present. In the washing process, chlorine is then consumed by not only the microorganisms and stained ware but also by organic particulate food or non-food soil loads typically found in the wash tank. Therefore, the amount of solids present in the wash tank requires a significant increase in the effective concentration of chlorine required to accomplish destaining.

We have found that the efficacy of chlorine in destaining and sanitizing can be increased by introducing chlorine into the rinse cycle. Water used in rinse cycles is typically hotter, potable water at a relatively neutral pH. The entire concentration of active chlorine can then interact with stains on the surface of ware. Active chlorine at a concentration of about 3 to 50 ppm (depending on temperature) can provide destaining properties to a rinse aid and can typically be effective in removing even stubborn stains on ware derived from coffee, tea or other food sources. Higher concentrations of active chlorine (25 to 150 ppm) in rinse water can enable the aqueous rinse to kill sufficient numbers of microorganisms to fully sanitize ware during the rinse cycle (a 5 $\log_{10}$ kill is typically considered sufficient for sanitizing action). For the purpose of this application, available chlorine means free active chlorine species derived from the source of chlorine when the chlorinated solid rinse aid is mixed with water to form an aqueous rinse. Free active chlorine species are chlorine compounds that can chemically bleach and sanitize.

Copeland, U.S. Pat. No. 4,594,175 discloses sanitization can occur within the range of 50–100 parts of available halogen or chlorine per million parts of rinse composition applied in hot tap water (120°–140° F.) in the rinse cycle of the dish machine.

However, in developing chlorinated rinse aids, we have found that significant incompatibility problems have arisen in attempts to combine organic sheeting agents with active sources of halogen in powdered, liquid and solid materials. Rinse aids often contain polymeric moieties, derived from ethylene oxide, propylene oxide, or mixtures thereof, which are particularly sensitive to rapid oxidative degradation in the presence of halogen sources. The literature relating to the use of many organic substances in the presence of active chlorine indicates that the concentration of the organic substance in the final composition should be maintained at less than 10% and preferably less than 5% in order to maintain a high concentration of active chlorine in the final composition. Sedgwick et al, European Patent Application Publication No. 195619 discloses sanitizing destaining and rinsing processes and compositions discloses the use of peracid compositions in rinse aids because of their desire to avoid contacting an organic with an active chlorine source. On page 3 of the published application, Sedgwick discloses that "a further disadvantage is that chlorine-release agents cannot easily be included in the rinse additive that must in any case be injected into the rinse line and, therefore, two products are required to be injected into the final rinse water." Further drawbacks relating to the use of active chlorine sources are disclosed.

At significantly higher concentrations of functional organic materials (sheeting aids, surfactants, etc.), rapid reaction between the organics and the chlorine can deplete the concentration of both the functional organics and chlorine resulting in failure to either effectively promote rinsing and sanitizing or destaining. Further, the manufacturer of solid materials involved in contact between the halogen source and organic material at elevated temperatures can result in rapid oxidation which can produce substantial quantities of smoke and in some cases fire. The manufacturers of product data sheet for CDB-56 TM, an active chlorine product of Olin Chemical Corporation, states that contamination of the active chlorine material with an organic material may start a chemical reaction possibly resulting in fire or explosion. Such hazards substantially increase the difficulty of manufacture of these products.

Accordingly, a substantial need exists in the art for rinse aids and rinse aid concentrates containing an effective amount of organic surfactant to provide rinsing action and an effective amount of a source of active halogen to provide either destaining, sanitizing or both.

BRIEF DESCRIPTION OF THE INVENTION

The invention is directed to a cast chlorinated rinse aid concentrate suitable for dispensing an aqueous rinse concentrate and to methods of rinsing with simultaneous stain removal or sanitization. When we say a material is a solid material, we mean that the material is in the form of a contiguous solid, weighing greater than about 5 grams, preferably greater than 200 grams, taking a regular geometric form. Such forms include a sphere, a cylinder, a truncated cone, a cube or rectangular block, etc. Such solids are dimensioned and packaged in order that an effective concentration of the surfactant and chlorine source can be obtained by an aqueous spray upon the surface of the cast solid material. The concentrate produced by the spray is introduced into the wash tank or the rinse line and is then directed to the dishware. The solid chlorinated rinse aid composition of the invention typically comprise an encapsulated chlorine source, one or more wetting or sheeting agents, optionally a hydrotrope solubilizer material and a diluent carrier.

The diluent carrier is any water soluble or dispensable castable room temperature solid material which can serve as a matrix or clathrate compound for the active ingredients, namely the surfactant and the encapsulated chlorine source.

The encapsulated chlorine source of the invention comprises the core of active chlorine having an inorganic intermediate coating or spacing layer, and an outer coating.

The cast solid rinse aid concentrates of the invention are manufactured by casting a hardenable concentrate within a suitable mold or container. The cast rinse aids of the invention are typically in the form of a solid cast block, wafer or other geometric shape held within a container suitable for placement in a dispenser or a dispensing portion of a warewashing machine such as that shown in Copeland, U.S. Pat. No. 4,690,305. We have found that the encapsulated chlorine sources, in combination with a polyalkylene oxide type rinse aid surfactants of the invention are stable during manufacture, storage, transportation, and use.

BRIEF DESCRIPTION OF THE DRAWINGS

FIG. 1 is a representation of a fluidized bed unit that can be used to manufacture the encapsulated chlorine source of the invention.

DETAILED DESCRIPTION OF THE INVENTION

Solid Rinse Aid

The cast solid chlorinated rinse aid composition of the invention typically comprise an active encapsulated chlorine source, one or more wetting or sheeting agents, optionally a hydrotrope-solubilizer, and a diluent carrier.

Active Chlorine Encapsulate

Chlorine Source

The chlorine releasing substances suitable as the core material of the encapsulated active chlorine compound include chlorine components capable of liberating active chlorine species such as a free elemental chlorine or $OCl^-$, under conditions normally used in warewashing processes. Useful inorganic sources of chlorine include solid materials that yield hypochlorite in aqueous environments including lithium hypochlorite, calcium hypochlorite, etc. Useful organic chlorine releasing compounds must be sufficiently soluble in water to have a hydrolysis constant (K) of about $10^{-4}$ or greater. Those with K values below $10^{-4}$ do not produce sufficiently high concentration of free available chlorine or other active chlorine species for effective bleaching. In general, hydrolysis constants of the N-chloro compounds range from $10^{-10}$ to approximately $10^{-3}$. The principle N-chloro compounds used in bleaching are the chlorinated isocyanurates, which are chlorimides.

Sodium dichloroisocyanurate dihydrate, a preferred chlorine releasing substance suitable as the core substance of the present encapsulated active chlorine compound, is commercially available from Olin Chemicals, Stamford, Conn., as CDB-56 TM; or as ACL-56 TM; Monsanto Company, St. Louis, Mo. The chemical structure of this compound is represented by the formula (III) below:

$$NaCl_2(NCO)_3.2H_2O \quad \text{(III)}$$

Intermediate Coating

The innermost, chlorine releasing core of the encapsulated active chlorine compound of the present rinse aid concentrate is surrounded by an intermediate coating or spacer layer. This intermediate coating is preferably inorganic, can comprise a filler or builder compound (or mixtures thereof) and provides a protective barrier or spacing between the innermost chlorine core and the organic outer layer.

Inorganic compounds suitable for use as the intermediate coating may include one or more of the following non-limiting examples of compounds, such as sodium bicarbonate, sodium carbonate, sodium sesquicarbonate, sodium borate, sodium sulfate dihydrate, sodium carbonate decahydrate, potassium bicarbonate, potassium sesquicarbonate, and potassium borate; phosphates such as diammonium phosphate, monocalcium phosphate monohydrate, tricalcium phosphate, calcium pyrophosphate, magnesium phosphate, monopotassium orthophosphate, potassium pyrophosphate, disodium orthophosphate, trisodium orthophosphate, tetrasodium pyrophosphate, sodium tripolyphosphate, and sodium phosphate glass; neutral soluble salts such as sodium sulfate and sodium chloride; silicates; and inorganic anti-redeposition agents.

Additionally, organic sequestrants can be used as a component of the builder material of the invention. Organic sequestrants include material such as polyacrylic acids, hydrolyzed styrene maleic anhydride copolymers, organic polyphosphonates, and others.

Outer Coating

The outer coating of the encapsulated active chlorine compound comprises either a synthetic detergent or a cellulosic polymer. The outer coating must remain sufficiently solid at temperatures likely to be encountered during storage of the product, for example, about 15°–50° C., and also remain stable at temperatures likely to be encountered during processing of the product into end use mixtures, e.g., temperatures of about 15°–95° C. The outer coating is typically applied as a solution in a suitable solvent, water being preferred because of its compatibility and non-reactivity with chlorine releasing agents, nonflammability, and non-toxicity.

Synthetic detergents useful as the outer coating include anionic, cationic, nonionic and amphoteric detergent compositions. Examples of useful anionic detergents include the higher alkyl mononuclear aromatic alkali-metal sulfonates, such as alkylbenzenesulfonates having about 9 to 13 carbon atoms in the alkyl group, wherein the alkyl group is derived from polypropylene, as described by Lewis in U.S. Pat. No. 2,477,382; or wherein the alkyl group is a hexene dimer or trimer as described by McEwan in U.S. Pat. No. 3,370,100; or wherein the alkyl group is derived from an alpha-olefin, as described by Swenson in U.S. Pat. No. 3,214,462. Primary and secondary alkyl sulfates or sulfonates may also be employed.

The soaps are included within the definition of anionic detergents as used herein. Examples of operable soaps soluble with the present invention are the sodium and potassium salts of acyclic monocarboxylic acids, having chain lengths of about 8 to about 22 carbon atoms.

A particularly suitable synthetic detergent for use as the outer coating of the encapsulated active chlorine compound of the present invention is sodium octyl sulfonate.

Cellulosic polymers are also useful as the outer coating of the encapsulated active chlorine source. Preferred cellulosic polymers include: cellulose derivatives such as sodium carboxymethyl cellulose, sodium hydroxyethyl cellulose, ethyl cellulose, hydroxypropyl cellulose, hydroxypropyl methyl cellulose, cellulose acetate phthalate, and hydroxypropyl methyl cellulose phthalate. A preferred cellulosic polymer is hydroxypropyl cellulose which is available from a number of suppliers, including Hercules, Inc., Wilmington, Del., under the mark KLUCEL-J ®.

Preferred Encapsulate Formulation

The encapsulated source of chlorine can comprise a core of a source of active chlorine, and one or more encapsulating layer. The encapsulate can contain about 30–80 wt-% of a source of chlorine in its core, preferably 40–75 wt-% and most preferably 45–70 wt-%. The encapsulate can contain one or more encapsulation layers. The encapsulation layer(s) can comprise 20 to 65 wt-%, preferably 25 to 60 wt-%, most preferably 30 to 55 wt-% of the encapsulate as a whole. The encapsulation layer can comprise an inner or spacing layer and an outer or protective layer. Typically, the inner layer is primarily inorganic and the outer layer is organic in the form of a surfactant, detergent polymer, etc. The encapsulate can comprise about 0.5 to 50 wt-%, preferably 5 to 40 wt-% of a first coating and about 5 to 70 wt-% and preferably 10 to 50 wt-% of the second coating. The most preferred encapsulating system comprises about 40 to 70 wt-% core of active chlorine, 15 to 45 wt-% inorganic first coating and 10 to 35 wt-% Of a second coat comprising a surfactant or a modified cellulosic polymer.

Preparation of Encapsulated Active Chlorine Compound

The outer coating of the present encapsulated active chlorine compound is conveniently applied by means of fluid bed coating apparatus. Referring to FIG. 1, a coating chamber or cylindrical tower 10 is shown, wherein the coating or encapsulation of the particles is accomplished. At the base of tower 10 is distributor plate 11. An unexpanded bed of the particles to be coated is contained in the tower 10. A downwardly projecting nozzle 12 constituting a spraying means is adjustably disposed within tower 10, and adapted to be adjusted vertically so that the liquid droplets of coating materials 15 and **15*a***, discharged in a downwardly diverging three-dimensional spray pattern, would just cover the upper surface area of the bed.

The coating solutions 15 and **15*a* are contained in vessels 14 and 14*a* and fed to nozzle 12 by pump 16. The spraying of coating solution 15 and 15*a* from nozzle 12 may be aided by pressurized air entering tower 10. Fluidizing gas passes through duct 18 and is forced through the distributor plate 11 by blower 19 and is either cooled by cooling system 21, or heated by heat exchanger 50, if required, in order to maintain the fluidizing gas within a desired temperature range. An exhaust blower 23** removes solvent vapors.

A known weight of a multiplicity of particles to be coated is placed on the distributor plate 11. Air is caused to flow upwardly by the force created by blower 19, thereby expanding the thickness of the layer of particles, and maintaining the particles in continuous motion within the volume defined by the expanded bed, thus forming a fluidized bed 51. A solution of a solidifiable coating substance 16, contained in vessel 14, is sprayed by means of pump 16 through nozzle 12 on fluidized bed 51 until all particles in the bed are completely coated 52. Particles coated by the above-described procedure are completely encapsulated with a continuous coating, and are free-flowing and nonagglomerated. It is preferred that each particle be fully covered to prevent the oxidizing chlorine source from reacting with the product matrix.

When applying the intermediate inorganic coating and subsequently the outer coating of synthetic detergent or cellulosic polymer, the double coating may be conducted in a single fluidized bed either by applying the intermediate coating, emptying the solution tank 15, filling the solution tank 15 with the outer coating solution and then applying the outer coating; or with a dual coating solution inlet to the atomizer as shown in FIG. 1 by outer coating solution 15*a*, intermediate coating solution tank 15*b* etc., and the pipes leading from 16*a* to the pump 16, the fluidized particles in the bed first being coated with the intermediate coating agent contained in solution tank 15*a*, this intermediate coating being allowed to dry and then an outer coating of synthetic detergent or cellulosic polymer contained in solution tank 15*a* being applied, both coatings being conducted in accordance with the previous discussion on the operation of the fluidized bed.

A third method of applying a double coating in a fluidized bed is to coat the core particles with the intermediate coating agent in a first fluidized bed apparatus. The coated material is then allowed to dry and placed in a second fluidized bed apparatus, wherein the encapsulated product produced in the first fluidized bed is coated with a second outer coating solution of synthetic detergent or cellulosic polymer. The fluidized bed operation is then conducted in accordance with the prior discussion.

Before removal of the encapsulated active chlorine source from the fluidized bed, the temperature in the bed can be increased so as to drive off any solvent remaining in the encapsulate. However, the bed temperature must remain below the melting temperature of the outer coating, and below the degradation temperature of the encapsulated core.

Solid Rinse Aid

The encapsulate can be combined in a solid rinse aid composition having a polyoxyalkylene wetting or sheeting agent and other optional ingredients.

Polyoxyalkylene Wetting Or Sheeting Agent

The rinse aid components of the cast solid rinse aid of the invention is a water soluble (can be solubilized by a hydrotrope-solubilizer), low foaming organic material capable of reducing the surface tension of the rinse water to promote sheeting action and to prevent spotting or streaking caused by beaded water after rinsing is complete. Such sheeting agents typically comprise a polyether compound prepared from ethylene oxide, propylene oxide, in a homopolymer or a block or heteric copolymer. Such polyether compounds are known as polyalkylene oxide polymers, polyoxyalkylene polymers, or polyalkylene glycol polymers. Such sheeting agents have a molecular weight in the range of about 500 to about 15,000. Certain types of polyoxypropylene-polyoxyethylene glycol polymer rinse aids have been found to be particularly useful. Those surfactants comprising at least one block of a polyoxypropylene and having at least one other block of polyoxyethylene attached to the polyoxypropylene block. Additional blocks of polyoxyethylene or polyoxypropylene can be present in a molecule. These materials having an average molecular weight in the range of about 500 to about 15,000 are commonly available as PLURONIC TM manufactured by the BASF Corporation and available under a variety of other trademarks of their chemical suppliers. In addition, rinse aid compositions called PLURONIC ® R (reverse pluronic structure) are also useful in the rinse aids of the invention. Additionally, rinse aids made by reacting ethylene oxide or propylene oxide with an alcohol anion and a alkyl phenol anion, a fatty acid anion or other such anionic material can be useful. One particularly useful rinse aid composition can comprise a capped polyalkoxyated $C_{6-24}$ linear alcohol. The rinse aids can be made with polyoxyethylene or polyoxypropylene units and can be capped with common agents forming an ether end group. One particular useful species of this rinse aid is a benzyl ether of a polyethoxylated $C_{12-14}$ linear alcohol; see U.S. Pat. No. 3,444,247.

Particular useful polyoxypropylene polyoxyethylene block polymers are those comprising a center block of polyoxypropylene units and blocks of polyoxyethylene units to each side of the center block. These copolymers have the formula (I) shown below:

$$(EO)_n—(PO)_m—(EO)_n \quad (I)$$

wherein m is an integer of 21 to 54; n is an integer of 7 to 128. Additional useful block copolymers are block polymers have a center block of polyoxyethylene units and blocks of polyoxypropylene units to each side of the center block. The copolymers have the formula (II) as shown below:

$$(PO)_n—(EO)_m—(PO)_n \quad (II)$$

wherein m is an integer of 14 to 164 and n is an integer of 9 to 22. The solid rinse aid composition can contain about 10–90 wt-%, preferably 20–70 wt-% of the low foaming surfactant.

Hydrotrope Solubilizer

Hydrotropy is a property that relates to the ability of materials to improve the solubility or miscibility of a substance in liquid phases in which the substance tends to be insoluble. Substances that provide hydrotropy are called hydrotropes and are used in relatively lower concentrations, than the materials to be solubilized.

A hydrotrope modifies the solvent to increase the solubility of an insoluble substance or creates micellar or mixed micellar structures resulting in a stable suspension of the insoluble substance in the solvent. The hydrotropic mechanism is not thoroughly understood. Apparently either hydrogen bonding between primary solvent, in this case water, and the insoluble substance are improved by the hydrotrope or the hydrotrope creates a micellar structure around the insoluble composition to maintain the material in a suspension/solution. In this invention, the hydrotropes are most useful in maintaining a uniform solution of the cast rinse composition both during manufacture and when dispersed at the use location. The combination of the polyalkylene oxide materials and the casting aids in this invention tends to be partially incompatible with aqueous solution and can undergo a phase change or phase separation during storage of the solution. The hydrotrope solubilizer maintains the rinse composition in a single phase solution having the nonionic rinsing agent uniformly distributed throughout the composition.

Preferred hydrotrope solubilizers are used at about 0.1 to 20 wt-% and include small molecule anionic surfactants. The most preferred hydrotrope solubilizers are used at about 10 to 20 wt-% and include $C_{1-5}$ substituted benzene sulfonic acid or sulfonated hydrotropes. One example of such a hydrotrope are xylene sulfonic acid or salts thereof. Such materials do not provide any pronounced surfactant or sheeting activity but significantly improved the solubility of the organic materials of the rinse aid in the aqueous rinse compositions.

Diluent Carrier

As defined above, the diluent carrier of the present rinse aid concentrate includes water-soluble castable, room-temperature solid materials which can serve as an absorptive base for the active ingredients; i.e., the encapsulated active chlorine compound and the surfactant. Solid, high molecular weight polyethylene glycol systems are applicable for use as the diluent of the instant rinse aid compositions. Such systems may be composed of individual solid polyethylene glycols, blends of solid polyethylene glycols or blends of solid and liquid polyethylene glycols. In all instances, it is necessary that the glycol system exhibit a minimum average molecular weight of about 3,500 in order to function in the instant formulations. Preferred polyethylene glycols suitable for use in the present rinse aid concentrate are those commercially available under the CARBOWAX trademark from Union Carbide Corp-, with CARBOWAX TM 8000 being preferred.

Preferred rinse aid concentrates according to the present invention will comprise about 1–30 wt-%, more preferably about 10–20 wt-%, of the diluent carrier.

Optional Sequestering Agent

Service water used in the rinse cycle of a dishwashing machine typically includes a substantial proportion of hardness components such as calcium and magnesium ions, which in the presence of certain rinse aids can precipitate and leave unsightly deposits of mixed calcium and magnesium salts, generally in the form of a carbonate. These deposits can often include other hardness components such as ferrous or ferric compounds and other common cations. Sequestration agents act to prevent or delay precipitation of the calcium or magnesium compounds.

Therefore, the present rinse aid concentrate may optionally include about 0.1–5.0%, more preferably about 0.01–0.5%, of one or more sequestering agents, or "sequestrants." These agents, also referred to as complexing agents or threshold agents, can be used in the invention to prevent the precipitation of hardness components in service water.

The sequestration agent may be used in the present rinse aid at a concentration which represents an amount that is stoichiometric with the hardness components. Alternatively, the sequestration agent may be utilized as a "threshold" agent at a concentration substantially less than an amount that would be stoichiometric with the hardness components. However, greater than trace amounts of threshold agent may thermodynamically delay crystal growth.

Useful sequestration agents can be organic or inorganic, but must be resistant to reaction with the encapsulated active chlorine compound, and must not have an undesirable rinse action-inhibiting interaction with the surfactant. The most common or widely used sequestration agents are those that coordinate metal ions through oxygen or nitrogen donor atoms, or groups containing oxygen or nitrogen atoms.

The rinse aid of the invention can comprise any water-conditioning organic phosphonate. The organophosphonic acid compounds are those having a carbon-to-phosphorus bond as shown in the following general formula:

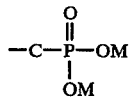

Compounds within the scope of the above description generally are included in one of at least two categories expressed by the following general formulas:

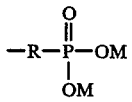

wherein R is a lower alkyl having from about 1 to 6 carbon atoms, e.g., methyl, ethyl, butyl, propyl, isopropyl, pentyl, isopentyl, and hexyl; substituted lower alkyl of from 1 to 6 carbon atoms, e.g., hydroxyl and amino-substituted alkyls; a mononuclear aromatic (aryl) radical, e.g., phenyl, benzene, etc., or a substituted mononuclear aromatic compound, e.g., hydroxyl, amino, lower alkyl-substituted aromatic, e.g., benzyl phosphonic acid, and M is a water-soluble cation, e.g., sodium, potassium, ammonium, lithium, etc., or hydrogen. Specific examples of compounds encompassed by the above formula include: methylphosphonic acid, ethylphosphonic acid, 2-hydroxyethylphosphonic acid, isopropylphosphonic acid , benzene phosphonic acid, benzyl phosphonic acid, and 2-phosphono-butane-tricarboxylic acid-1,2,4.

Another general formula for organic phosphonate is:

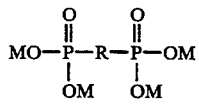

wherein R is an alkylene having from about 1 to about 12 carbon atoms or a substituted alkylene having from about 1 to about 12 carbon atoms, e.g., hydroxyl, amino, etc., substituted alkylenes, and M is the same as defined above. Specific examples of compounds encompassed by this formula include methylene diphosphonic acid, ethylidene diphosphonic acid, isopropylidene diphosphonic acid, 1-hydroxyethylidene-1,1-diphosphonic acid, hexamethylene diphosphonic acid, trimethylene diphosphonic acid, decamethylene diphosphonic acid, 1-hydroxy propylidene diphosphonic acid, 1,6-dihydroxy, 1,6-dimethyl, hexamethylene diphosphonic acid, dihydroxy, diethyl ethylene diphosphonic acid. Other organic sequestration agents include, for example, polymers and copolymers of maleic anhydride, polyacrylic acid or polymethacrylic acid, polyacrylic homo or interpolymers, and mixtures thereof.

Examples of inorganic sequestration agents include condensed phosphates of the general formula (IV) below:

(IV)

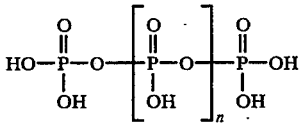

wherein n is greater than or equal to 1, preferably n=1 to 4; and the alkali metal or alkaline earth metal salts thereof.

Typically, the sequestration agent, if included in the present rinse aid concentrate, is added to the diluent carrier prior to addition of the encapsulated active chlorine compound.

Other Optional Components

Other optional components or adjuvants may be included in the present rinse aid concentrate, typically by being mixed with the diluent carrier prior to addition of the encapsulated active chlorine compound.

The rinse aid concentrate may optionally also contain from about 0.01–5.0%, more preferably about 0.01–1.0%, of a defoaming agent. Useful defoaming agents include those commercially available as Silicone X2-3311, Dow Corning.

The present rinse aid composition may also optionally comprise adjuvants that enhance performance, stability, aesthetic appeal, processing, packaging, or household acceptance. Such materials include, for example, optional coloring agents or dyes, and perfumes or fragrances. These materials should be selected from dyes and perfume varieties which are stable against degradation in the presence of strong chlorine releasing agents. Where used, these optional components can be provided in quantities well known to those of ordinary skill in the art.

Dyes provide for a more pleasing appearance of the rinse aid. Any water soluble dye which does not interfere with the other desirable properties of the invention may be used. Suitable dyes include Sandogran Blue 2 GLS, Acid Yellow 17, available from Sandoz; Fastusol Blue, available from Mobay Chemical Corp.; Acid Orange 7, available from American Cyanamid; Basic Violet 10, available from Sandoz; Acid Yellow 23, available from GAF; Sap Green available from Keystone Analine and Chemical; Metanil Yellow, available from Keystone Analine and Chemical; Acid Blue 9, available from Hilton Davis; Hisol Fast Red, available from Capitol Color and Chemical; Fluorescein, available from Capitol Color and Chemical; Acid Yellow 23, available from Atlanta Chemical; and Acid Green 25, available from Ciba-Geigy.

Preferred Solid Formulation

The solid chlorinated rinse aid concentrates of the present invention will comprise about 20–70%, preferably about 30–60%, of low foaming surfactant; about 10–50%, preferably about 20–30%, of an encapsulated active chlorine compound; and optionally, about 0–30%, preferably 10–20%, of a diluent carrier. The rinse aid concentrate may further comprise about 0.01–5.0%, preferably about 0.01–1%, of a defoaming agent; 0.01 to 20.0%, preferably about 10 to 20 wt-% of a hydrotrope; about 0.01%–5.0%, preferably 0.01–0.5%, of a sequestering agent; and adjuvants in an amount readily determinable by those of skill in the art. By low foaming surfactant, we mean a surfactant material that when tested, has a Ross Miles foam height (0.1% aqueous solution at 50° C.) of 80 mm or less.

Method of Preparation

The solid, cast, rinse aid concentrate of the invention may be prepared by any suitable procedure; however, the following procedure is preferred. First, the surfactant and diluent carrier are charged into a suitable steam-jacketed mixing vessel. If the surfactant is a solid, it is melted before placing it in the vessel. The resulting solution is heated with mixing to approximately 170° F. The optional hydrotropes is then added if included in the formulation.

After the addition of these components, the mixture is allowed to cool with continued mixing until it reaches about 140° F. Additional cooling is initiated by adding water to the steam Jacket, and is continued to about 120°–128° F. Optional components such as hydrotropes defoamers, sequestrants, and/or adjuvants such as dyes or perfumes are next added, with continued mixing.

At about 128° F. or less, the encapsulated chlorine source prepared as described above is added and the solution thoroughly mixed for about 5 mins., without any additional heating.

The resulting mixture is then poured into a suitable container and allowed to cool to room temperature, at which time it will be relatively solid. With time (24 hours), the product cures or hardens, forming a solid in the shape of the container into which it is cast. Additional cooling sources can be used to promote solidification including chilled water, cooling air, etc.

The container may be formed of plastic material such as a polyester, polyethylene, polypropylene or laminate thereof; a paperboard laminate or composite; a metal or metal foil or laminate thereof; a thermosetting material such as a polyurethane solid or a polyurethane foam; or the like, or any other suitable material. For convenient use in typical household or institutional warewashing machines, it is suggested that the container have a capacity sufficient for 50 to 5,000 grams, preferably 100 to 2,500 grams and be of any convenient shape. For household purposes, the container can surround the solid rinse aid dispenser or basket, so that the composition solidifies directly in the dispenser. The containers can be individual molds which are provided with removable, tightly sealed covers, and can serve as packaging for the solid rinse aid. It is also envisioned that the solid rinse aids may be removed from the containers in which they were cast for repackaging prior to sale.

Methods of Use

When dispensed into an aqueous rinse, at least two preferred modes of use of the present rinse aid concentrate are contemplated. For high-temperature use, e.g., where the temperature of the rinse water is above about 160° F., the encapsulated active chlorine source is preferably present in the aqueous rinse at a concentration of about 3–50 ppm, whereby the active chlorine source primarily provides for stain removal. This lower chlorine content is sufficient, because sanitization is inherently provided for by the high temperature of the rinse water. For low temperature use, e.g., where the temperature of the rinse water is about 120° F. or lower, the encapsulated active chlorine source is preferably present in the aqueous rinse at a concentration of about 25–125 ppm as available chlorine, whereby the active chlorine source can provide for sanitization as well as stain removal. This higher chlorine concentration is intended to make up for any reduction in sanitization due to the lower temperature of the rinse water. Intermediate concentrations of the encapsulated active chlorine source may also be useful when the temperature of the rinse water is between about 120°–160° F. Chlorine concentration in the aqueous rinse can be controlled by any suitable method known to those in the art.

The invention is further described by reference to the following detailed examples.

EXAMPLE 1

TABLE 1

Chlorinated Rinse Additive

| Item | Raw Material | Supplier | Percent | Weight |
|---|---|---|---|---|
| 1 | Benzyl Ether of Ethyoxylated $C_{2-14}$ linear alcohols | Ecolab | 24.00 | 4.800 |
| 2 | Block Copolymer I* | Ecolab | 10.30 | 2.060 |
| 3 | Pluronic F87 TM | BASF | 5.00 | 1.000 |
| 4 | Carbowax 8000 ® | Union Carbide | 15.18 | 3.036 |
| 5 | Sodium Xylene Sulfonate | Witco | 17.00 | 3.400 |
| 6 | Dequest 2010 TM | Monsanto | 0.02 | 0.004 |
| 7 | Silicone X2-3311 | Dow Corning | 0.50 | 0.100 |
| 8 | Encapsulated Product of Example 19 | Ecolab | 28.00 | 5.600 |

*I = 32.2 wt-% EO, MW = 2500-3400; reverse PLURONIC type (PO)(EO)(PO/EO)(EO)(PO); Hydroxyl Number = 33–45

Items 1, 2, 3 and 4 were charged into the five gallon mix tank. The contents were heated through a steam jacket, while being mixed. Mixing and heating continued until a temperature of 200° F. was achieved.

Item 5 was charged into the tank. The system was cooled using tempered water in the jacket. Cooling continued until a temperature of 135° F. was achieved.

Items 6 and 7 were charged. Cooling continued until a temperature of 129° F. was achieved.

Item 8 was charged. Mixing continued for another 3 minutes. The mixture was packaged and chilled. After 15 minutes, the packaged product was removed from the chiller and continued cooling at room temperature.

EXAMPLE 2

TABLE 2

Chlorinated Rinse Additive

| Item | Raw Material | Supplier | Percent | Weight |
|---|---|---|---|---|
| 1 | Block Copolymer I | Ecolab | 15.00 | 15.00 |
| 2 | Benzyl ether of Ethoxylated $C_{12-14}$ linear alcohol | Ecolab | 15.00 | 15.00 |
| 3 | Carbowax 8000 ® | Union Carbide | 19.50 | 19.50 |
| 4 | Sodium Xylene Sulfonate | Witco | 14.80 | 14.80 |
| 5 | Pluronic F87 TM | BASF | 15.00 | 15.00 |
| 6 | Potassium Iodide | LaPorte Industries | 0.02 | 0.02 |
| 7 | Silicone X2-3311 | Dow Corning | 0.50 | 0.50 |
| 8 | Encapsulated Product of Example 19 | Ecolab | 20.00 | 20.00 |

Items 1, 2 and 3 were charged into a 200 ml glass beaker and heated to 160° F. (while mixing).

Items 4, 5, 6 and 7 were charged into the beaker. The system was allowed to cool at 130°–135° F.

Item 8 was charged into the beaker and the mixing continued for another minute. Then the product was poured and allowed to cool under ambient conditions.

EXAMPLE 3

TABLE 3

Chlorinated Rinse Additive

| Item | Raw Material | Supplier | Percent | Weight |
|---|---|---|---|---|
| 1 | Block Copolymer I | Ecolab | 17.00 | 17.00 |
| 2 | Plurafac RA40 TM | BASF | 17.00 | 17.00 |
| 3 | Carbowax 8000 ® | Union Carbide | 16.00 | 16.00 |
| 4 | Pluronic F87 TM | BASF | 12.48 | 14.48 |
| 5 | Sodium Xylene Sulfonate | Witco | 13.00 | 13.00 |
| 6 | Dequest 2010 TM | Monsanto | 0.02 | 24.00 |
| 7 | Encapsulated Product of Example 19 | Ecolab | 24.00 | 24.00 |

Items 1, 2 and 3 were charged into a 200 ml beaker. This system was mixed and heated until a temperature of 165° F. was achieved.

Item 4 was charged to the mixture. The temperature dropped with this addition to 132° F.

Item 5 was charged. The mixture was now at 115° F. Heated the mixture to 125° F.

Item 6 was charged into the mixture.

Item 7 was charged into the mixture. Mixing continued for another minute. Then the product was packaged and cooled under ambient conditions.

EXAMPLE 4

TABLE 4

Chlorinated Rinse Additive

| Item | Raw Material | Supplier | Percent | Weight |
|---|---|---|---|---|
| 1 | Plurafac RA40 TM | BASF | 32.98 | 32.98 |
| 2 | Carbowax 8000 ® | Union Carbide | 16.00 | 48.00 |
| 3 | Pluronic F87 TM | BASF | 4.00 | 12.00 |
| 4 | Sodium Xylene Sulfonate | Witco | 13.00 | 39.00 |
| 5 | Dequest 2010 TM | Monsanto | 0.02 | 0.06 |
| 6 | Pluronic F87 TM | BASF | 4.00 | 12.00 |
| 7 | Encapsulated Product of Example 21 | Ecolab | 30.00 | 90.00 |

Items 1 and 2 were charged into a 600 ml beaker, mixed and heated to 158° F.

Item 3 was charged to the mixture. The temperature dropped to 148° F.

Item 4 was charged to the mixture. The temperature dropped to 144° F.

Item 5 was charged to the mixture. There was not a change in temperature with this addition.

Item 6 was charged to the mixture. The temperature dropped to 125° F. At this temperature, the base viscosity was 3000 cps.

Item 7 was charged and mixed for one minute. The product was packaged and cooled under ambient conditions.

EXAMPLE 5

TABLE 5

Chlorinated Rinse Additive

| Item | Raw Material | Supplier | Percent | Weight |
|---|---|---|---|---|
| 1 | Plurafac RA40 TM | BASF | 34.98 | 104.94 |
| 2 | Carbowax 8000 ® | Union Carbide | 16.00 | 48.00 |
| 3 | Sodium Octyl Sulfonate | Stepan | 11.00 | 33.00 |

TABLE 5-continued

| Chlorinated Rinse Additive | | | | |
|---|---|---|---|---|
| Item | Raw Material | Supplier | Percent | Weight |
| 4 | Dequest 2010 TM | Monsanto | 0.02 | 0.06 |
| 5 | Pluronic F87 TM | BASF | 8.00 | 24.00 |
| 6 | Encapsulated Product of Example 19 | Ecolab | 30.00 | 90.00 |

Items 1 and 2 were charged into a 600 ml beaker. The system was mixed and heated until a temperature of 150° F. was achieved.

Item 3 was charged to the mixture. The temperature dropped to 129° F.

Item 4 was charged to the mixture and no change in temperature was observed.

Item 5 was charged to the mixture and the temperature dropped to 110° F.

Item 6 was added at 110° F., mixed for one minute, packaged, and cooled under ambient conditions.

EXAMPLE 6

TABLE 6

| Chlorinated Rinse Additive | | | | |
|---|---|---|---|---|
| Item | Raw Material | Supplier | Percent | Weight |
| 1 | Pluronic 25R2 TM | BASF | 30.00 | 120.00 |
| 2 | Carbowax 8000 ® | Union Carbide | 16.00 | 64.00 |
| 3 | Pluronic 25R8 TM | BASF | 12.00 | 48.00 |
| 4 | Sodium Xylene Sulfonate | Witco | 9.98 | 39.92 |
| 5 | Dequest 2010 TM | Monsanto | 0.02 | 0.08 |
| 6 | Encapsulated Product of Example 22 | Ecolab | 32.00 | 128.00 |

Items 1 and 2 were charged into a 600 ml beaker and heated to 172° F.

Item 3 was charged to the mixture. The temperature dropped to 140° F.

Item 4 was charged into the mixture. The temperature dropped to 135° F.

Item 5 was charged into the mixture. The temperature was unaffected by this addition.

Item 6 was charged, mixed for one minute, packaged, and cooled under ambient conditions.

EXAMPLE 7

TABLE 7

| Chlorinated Rinse Additive | | | | |
|---|---|---|---|---|
| Item | Raw Material | Supplier | Percent | Weight |
| 1 | $(EO)_x(PO)_y$ Copolymer III* | Ecolab | 26.000 | 26.000 |
| 2 | Benzyl ether of Ethoxylated $C_{12-14}$ linear alcohol Block Copolymer I | Ecolab | 3.000 | 3.000 |
| 3 | Pluronic 25R8 TM | BASF | 28.495 | 28.495 |
| 4 | Carbowax 8000 ® | Union Carbide | 6.500 | 6.500 |
| 5 | Sodium Xylene Sulfonate | Witco | 10.000 | 10.000 |
| 6 | Acid Yellow 17 | Sandoz Chemical | 0.005 | 0.005 |
| 7 | Encapsulate Product of Example 19 | Ecolab | 26.000 | 26.000 |

*III = 28.38 wt-% EO, Hydroxyl Number = 26–45, MW = 2500–4300

Item 2 and 6 were premixed and heated to 210° F. in a 200 ml beaker.

Items 1, 3 and 4 were charged into the beaker. No additional heat was added.

Item 5 was charged into the mixture. The temperature was allowed to cool under ambient conditions while mixing.

Item 7 was charged after the temperature of the mixture was between 130°–135° F. The mixture was poured and cooled under ambient conditions.

EXAMPLE 8

TABLE 8

| Chlorinated Rinse Additive | | | | |
|---|---|---|---|---|
| Item | Raw Material | Supplier | Percent | Weight |
| 1 | Pluronic L44 TM | BASF | 17.00 | 25.50 |
| 2 | Pluronic L43 TM | BASF | 17.00 | 25.50 |
| 3 | Block Copolymer I | Ecolab | 2.00 | 3.00 |
| 4 | Pluronic 25R8 TM | BASF | 4.00 | 6.00 |
| 5 | Carbowax 8000 ® | Union Carbide | 15.00 | 22.50 |
| 6 | Sodium Xylene Sulfonate | Witco | 15.00 | 22.50 |
| 7 | Encapsulated Product of Example 19 | Ecolab | 30.00 | 45.00 |

Items 1, 2, 3, 4 and 5 were charged into a 300 ml beaker. These items were mixed and heated until a temperature of 200° F. was achieved.

Item 6 was charged into the beaker. The temperature was allowed to cool (with mixing) until a temperature of 142° F. was achieved.

Item 7 was charged into the beaker. The mixing continued for one minute. The product was packaged and cooled overnight, under ambient conditions.

EXAMPLE 9

TABLE 9

| Chlorinated Rinse Additive | | | | |
|---|---|---|---|---|
| Item | Raw Material | Supplier | Percent | Weight |
| 1 | Pluronic 25R2 TM | BASF | 19.00 | 38.00 |
| 2 | Dioctylsulfo-succinate | Mona | 7.00 | 14.00 |
| 3 | Carbowax 8000 ® | Union Carbide | 15.00 | 30.00 |
| 4 | Pluronic 25R8 TM | BASF | 19.00 | 38.00 |
| 5 | Sodium Xylene Sulfonate | Witco | 10.00 | 20.00 |
| 6 | Encapsulate Product of Example 19 | Ecolab | 30.00 | 60.00 |

Items 1 and 2 were charged into a 300 ml beaker, mixed, and heated to 160°–170° F. This temperature was maintained for about 10 minutes (with continued mixing) until bubbles subsided.

Items 3 and 4 were charged into the beaker. The mixture was allowed to cool to 150°–155° F.

Item 5 was charged into the beaker. The mixture was cooled to 130°–135° F.

Item 6 was charged into the mixture. Mixing continued for another minute. The product was packaged and cooled under ambient conditions.

EXAMPLE 10

TABLE 10

| Chlorinated Rinse Additive | | | | |
|---|---|---|---|---|
| Item | Raw Material | Supplier | Percent | Weight |
| 1 | $(EO)_x(PO)_y$ Block Copolymer III | Ecolab | 30.00 | 90.00 |
| 2 | Pluronic 25R8 TM | BASF | 20.00 | 60.00 |

TABLE 10-continued

| Chlorinated Rinse Additive | | | | |
|---|---|---|---|---|
| Item | Raw Material | Supplier | Percent | Weight |
| 3 | Carbowax 8000 ® | Union Carbide | 12.00 | 36.00 |
| 4 | Sodium Xylene Sulfonate | Witco | 12.00 | 36.00 |
| 5 | Encapsulate Product of Example 20 | Ecolab | 26.00 | 78.00 |

Items 1, 2 and 3 were charged into a 600 ml beaker, mixed, and heated to 160°-180° F.

Item 4 was charged. The mixture cooled to 130°-135° F.

Item 5 was charged to the mixture and mixed for an additional minute, was packaged and cooled under ambient conditions.

EXAMPLE 11

TABLE 11

| Chlorinated Rinse Additive | | | | |
|---|---|---|---|---|
| Item | Raw Material | Supplier | Percent | Weight |
| 1 | $(EO)_x(PO)_y$ Block Copolymer III | Ecolab | 31.00 | 31.00 |
| 2 | Pluronic 25R8 TM | BASF | 31.00 | 31.00 |
| 3 | Sodium Xylene Sulfonate | Witco | 12.00 | 12.00 |
| 4 | Encapsulate Product of Example 19 | Ecolab | 26.00 | 26.00 |

Items 1 and 2 were charged into a 200 ml beaker. The raw materials were mixed and heated to 180°-200° F.

Item 3 was charged into the mixture. The system was cooled to 128° F.

Item 4 was charged and mixing continued for another minute. The product was packaged and cooled under ambient conditions.

EXAMPLE 12

TABLE 12

| Chlorinated Rinse Additive | | | | |
|---|---|---|---|---|
| Item | Raw Material | Supplier | Percent | Weight |
| 1 | $(EO)_x(PO)_y$ Block Copolymer III | Ecolab | 28.00 | 28.00 |
| 2 | Carbowax 8000 ® | Union Carbide | 13.50 | 13.50 |
| 3 | Pluronic 25R8 TM | BASF | 18.50 | 18.50 |
| 4 | Petro BA TM | Desoto Chemical | 12.00 | 12.00 |
| 5 | Pluronic 25R2 | BASF | 2.00 | 2.00 |
| 6 | Encapsulated Product of Example 19 | Ecolab | 26.00 | 26.00 |

Items 1 and 2 were charged into a 200 ml beaker and were mixed and heated to 200° F.

Items 3 and 4 were dry blended together then charged into the 200° F. mixture. The system was allowed to cool to 128° F.

Item 5 was charged into the mixture.

Item 6 was charged into the mixture. Mixing continued for one minute. The product was packaged and cooled under ambient conditions.

EXAMPLE 13

TABLE 13

| Chlorinated Rinse Additive | | | | |
|---|---|---|---|---|
| Item | Raw Material | Supplier | Percent | Weight |
| 1 | Pluronic L43 TM | BASF | 15.00 | 15.00 |
| 2 | Pluronic L44 TM | BASF | 15.00 | 15.00 |
| 3 | Block Copolymer I | Ecolab | 6.00 | 6.00 |
| 4 | Pluronic 25R8 TM | BASF | 4.00 | 4.00 |
| 5 | Carbowax 8000 ® | Union Carbide | 15.00 | 15.00 |
| 6 | Sodium Xylene Sulfonate | Witco | 16.98 | 16.98 |
| 7 | Sandogran Blue TM 2-GLS (powder) | Sandoz Chemicals | 0.02 | 0.02 |
| 8 | Encapsulate Product of Example 19 | Ecolab | 28.00 | 28.00 |

Items 1, 2, 3, 4 and 5 were charged into a 200 ml beaker. The raw materials were mixed and heated to 200° F.

Item 7 was added to the mixture. Mixing continued until the dye was evenly dispersed.

Item 6 was added to the mixture. The system was cooled to a temperature of 130°-135° F.

Item 8 was charged into the mixture. Mixing continued for another minute. the product was packaged and cooled under ambient conditions.

EXAMPLE 14

TABLE 14

| Chlorinated Rinse Additive | | | | |
|---|---|---|---|---|
| Item | Raw Material | Supplier | Percent | Weight |
| 1 | $(EO)_x(PO)_y$ Block Copolymer III | Ecolab | 30.0000 | 30.0000 |
| 2 | Carbowax 8000 ® | Union Carbide | 15.0000 | 15.0000 |
| 3 | Pluronic 25R8 TM | BASF | 21.0000 | 21.0000 |
| 4 | Pluronic 25R2 TM | BASF | 2.4975 | 2.5000 |
| 5 | Petro BA TM | DeSoto Chemical | 5.0000 | 5.0000 |
| 6 | Water | — | 0.5000 | 0.5000 |
| 7 | Encapsulate Product of Example 19 | Ecolab | 26.0000 | 26.0000 |
| 8 | Acid Yellow 23 | Atlantic Chemical | 0.0026 | 0.0025 |

Items 6 and 8 were premixed until the color of the dye was developed.

Items 1, 2, 3 and 4 were charged into a 200 ml beaker. The materials were mixed and heated to 180°-200° F.

Item 5 was charged to the mixture. The system was allowed to cool to 125° F.

The premix containing items 6 and 8 was charged into the mixture. Mixing continued for 2 minutes.

Item 7 was charged into the mixture. Mixing continued for one minute. The product was packaged and cooled under ambient conditions.

EXAMPLE 15

TABLE 15

| Chlorinated Rinse Additive | | | | |
|---|---|---|---|---|
| Item | Raw Material | Supplier | Percent | Weight |
| 1 | $(EO)_x(PO)_y$ Block Copolymer II | Ecolab | 11.00 | 110.00 |
| 2 | Pluronic L43 TM | BASF | 23.00 | 230.00 |
| 3 | Block Copolymer I | Ecolab | 2.00 | 20.00 |
| 4 | Pluronic 25R8 TM | BASF | 4.00 | 40.00 |

TABLE 15-continued

| Chlorinated Rinse Additive | | | | |
|---|---|---|---|---|
| Item | Raw Material | Supplier | Percent | Weight |
| 5 | Carbowax 8000 ® | Union Carbide | 15.00 | 150.00 |
| 6 | Sodium Xylene Sulfonate | Witco | 15.00 | 150.00 |
| 7 | Encapsulate Product of Example 19 | Ecolab | 30.00 | 300.00 |

**II = EO terminated, EO/PO block copolymer; MW = 1300–1600 30–35 wt-% EO

Items 1, 2, 3, 4 and 5 were charged into a 1500 g stainless steel mixing vessel. These materials were mixed and heated until a temperature of 200° F. was achieved.

Item 6 was charged. The mixture was cooled to 134° F.

Item 7 was charged to the mixture. Mixing continued for one minute. The product was packaged and cooled under ambient conditions.

EXAMPLE 16

TABLE 16

| Chlorinated Rinse Additive | | | | |
|---|---|---|---|---|
| Item | Raw Material | Supplier | Percent | Weight |
| 1 | Pluronic 17R8 TM | BASF | 4.00 | 4.00 |
| 2 | Block Copolymer I | Ecolab | 6.00 | 6.00 |
| 3 | Pluronic L44 TM | BASF | 30.00 | 30.00 |
| 4 | Carbowax 8000 ® | Union Carbide | 15.00 | 15.00 |
| 5 | Sodium Xylene Sulfonate | Witco | 15.00 | 15.00 |
| 6 | Encapsulate Product of Example 19 | Ecolab | 30.00 | 300.00 |

Items 1, 2, 3 and 4 were charged into a 200 ml glass beaker. The materials were mixed and heated until a temperature of 200° F. was achieved.

Item 5 was charged into the mixture. The system was allowed to cool to 130°–135° F.

Item 6 was charged into the mixture. Mixing continued for an additional minute. The product was packaged and cooled under ambient conditions.

EXAMPLE 17

TABLE 17

| Chlorinated Rinse Additive | | | | |
|---|---|---|---|---|
| Item | Raw Material | Supplier | Percent | Weight |
| 1 | Benzyl Ether of Ethoxylated $C_{12-14}$ Linear Alcohol | Ecolab | 17.00 | 17.00 |
| 2 | Block Copolymer I | Ecolab | 6.0 | 6.0 |
| 3 | Pluronic 25R8 TM | BASF | 15.0 | 15.0 |
| 4 | Carbowax 8000 ® | Union Carbide | 15.0 | 15.0 |
| 5 | Pluronic L43 TM | BASF | 17.0 | 17.0 |
| 6 | Encapsulate Product of Example 19 | Ecolab | 30.0 | 30.0 |

Items 1, 2, 3 and 4 were charged into a 200 ml glass beaker. The contents were heated on a hot plate up to 200° F.

Item 5 was charged. The system was cooled to 128° F. (no external cooling).

Item 6 was charged. The system mixed until homogeneous. The sample was poured into a small plastic cup and was allowed to cool under ambient conditions.

EXAMPLE 18

TABLE 18

| Chlorinated Rinse Additive | | | | |
|---|---|---|---|---|
| Item | Raw Material | Supplier | Percent | Weight |
| 1 | Benzyl Ether of Ethoxylated $C_{12-14}$ Linear Alcohol | Ecolab | 17.0 | 17.0 |
| 2 | Block Copolymer I | Ecolab | 6.0 | 6.0 |
| 3 | Pluronic 25R8 ® | BASF | 30.0 | 30.0 |
| 4 | Pluronic L43 TM | BASF | 17.0 | 17.0 |
| 5 | Encapsulate Product of Example 19 | Ecolab | 30.0 | 30.0 |

Items 1, 2 and 3 were charged into a 200 ml glass beaker. The contents were heated on a hot plate up to 200° F.

Item 4 was charged into a beaker. The system was cooled to 128° F. (no external cooling).

Item 5 was charged. The system was mixed until homogeneous. The sample was poured into a small plastic cup and allowed to cool under ambient conditions.

EXAMPLE 19

Preparation of Encapsulated Active Chlorine Compound

An encapsulated active chlorine compound was prepared from the ingredients shown in Table 1 below.

TABLE 19

| Encapsulated Active Chlorine Compound Formulation | |
|---|---|
| Raw Material | Parts to Net 100 Parts |
| Sodium Dichloroisocyanurate Dihydrate[1] | 61.25 |
| Sodium Sulfate | 16.50 |
| Sodium Tripolyphosphate | 5.50 |
| Water, Soft | 68.97 |
| Sodium Octyl Sulfonate | 49.62 |
| Water, Soft | 49.62 |
| Water, Evaporated | −151.46[2] |
| Total | 100.00 |

[1]Commercially available as CDB TM 56 from Olin Chemicals, Stanford, Connecticut.
[2]Water added to initial formulation, but not present in final, dried product due to evaporation.

One hundred lbs of encapsulated active chlorine compound comprising the ingredients listed in Table 1 above were prepared according to the following procedure: 61.25 lbs of granular diochloroisocyanurate dihydrate (CDB TM 56 from Olin Corp.) with particle sizes of about 10 to 60 U.S. Mesh were placed onto the distributor plate of the cylindrical coating tower. The particles were fluidized and suspended by an upwardly moving air stream supplied by blower. The temperature of the bed was maintained between 43° C. and 83° C. throughout the coating process.

The intermediate inorganic coating solution was prepared by dissolving 16.5 lbs of sodium sulfate and 5.5 lbs of sodium tripolyphosphate in 68.97 lbs of soft water. The intermediate coating solution was sprayed on the fluidized particles, through nozzle, appropriately adjusted as to height. The intermediate coating solution was applied to the fluidized particles for a period of about 1 hour, the resulting coated particles being of uniform size and being dry and free flowing.

The outer coating solution was prepared by dissolving 49.62 lbs of sodium octyl sulfonate in 49.62 lbs of soft water. The outer coating solution was sprayed on the fluidized particles in the same manner as the intermediate coating. The outer coating solution was applied to the fluidized particles for a period of about 1 hour, the resulting coated particles being of substantially uniform size and being dry and free flowing.

After addition of the outer coating, the bed temperature was allowed to rise to about 180° F. to assure that no free moisture was left in the resulting encapsulate. The encapsulates were then allowed to cool to less than 110° F., and discharged from the system.

EXAMPLE 20

Preparation of Encapsulated Active Chlorine Compound

An encapsulated active chlorine compound was prepared from the ingredients shown in Table 2 below.

TABLE 20

| Encapsulated Chlorine Source Formulation | |
|---|---|
| Raw Material | Parts to Net 100 Parts |
| Sodium Dichloroisocyanurate Dihydrate[1] | 60.53 |
| Sodium Sulfate | 25.80 |
| Sodium Tripolyphosphate, LD | 8.60 |
| Water, Soft | 102.96 |
| Hydroxypropyl Cellulose[2] | 4.93 |
| Water, Soft | 233.33 |
| Water, Evaporated | −335.82[3] |
| Total | 100.00 |

[1]Commercially available as CDB-56 TM from Olin Chemicals, Stanford, Connecticut, in medium or coarse granulations. The coarse granulation was used in this experiment.
[2]Commercially available as Klucel TM J from Hercules, Inc., Wilmington, Delaware.
[3]Water added to initial formulation, but not present in final, dried product due to evaporation.

Thirty lbs of encapsulated active chlorine compound comprising the ingredients listed in Table 1 above was prepared according to the following procedure: 18.16 lbs of granular diochloroisocyanurate dihydrate with particle sizes of about 10 to 60 U.S. Mesh were placed onto the distributor plate of the cylindrical coating tower. The particles were fluidized and suspended by an upwardly moving air stream supplied by blower. The temperature of the bed was maintained between 43° C. and 83° C. throughout the coating process.

The intermediate inorganic coating solution was prepared by dissolving 7.75 lbs of sodium sulfate and 2.58 lbs of sodium tripolyphosphate in 30.89 lbs of soft water. The intermediate coating solution was sprayed on the fluidized particles through a nozzle appropriately adjusted to height. The intermediate coating solution was applied to the fluidized particles for a period of about 1 hour. The resulting coated particles being of uniform size and being dry and free flowing.

The outer coating solution was prepared by dissolving 1.48 lbs of hydroxypropyl cellulose (Klucel J) in 70 lbs of soft water. The outer coating solution was sprayed on the fluidized particles in the same manner as the intermediate solution. The outer solution was applied to the fluidized particles for about 1 hour. The resulting particles being of substantially uniform size and being dry and free flowing.

After addition of the outer coating, the bed temperature was allowed to rise to about 180° F. to assure that no free moisture was left in the resulting encapsulate. The encapsulates were then allowed to cool to less than 110° F., and discharged from the system.

EXAMPLE 21

TABLE 21

| Raw Material | Parts to Net 100 Parts |
|---|---|
| Sodium Dichloroisocyanurate Dihydrate[1] | 61.87 |
| Sodium Tripolyphosphate | 18.38 |
| Water, Soft | 104.18 |
| Sodium Octyl Sulfonate | 50.13 |
| Water, Soft | 0.10 |
| Water, Evaporated[2] | −134.56 |
| Total | 100.00 |

[1]Commercially available as CDB-56 TM from Olin Chemicals, Stanford, Connecticut.
[2]Water added to initial formulation, but not present in the final. Dried product due to evaporation.

34.65 lbs of encapsulated active chlorine compound comprising the ingredients listed above were prepared according to the following procedures: 21.44 lbs of granular dichloroisocyanurate dihydrate (CDB-56 TM from Olin Corp.) with particle size of about 10 to 60 U.S. mesh were placed onto the distributor plate of the cylindrical coating tower. The particles were fluidized and suspended by an upwardly moving air stream supplied by the blower. The temperature of the bed was maintained between 43° C. and 83° C. throughout the process.

The intermediate inorganic coating solution was prepared by dissolving 6.37 lbs sodium tripolyphosphate in 36.10 lbs of soft water. The intermediate coating solution was sprayed on the fluidized particles through a nozzle appropriately adjusted to height. The intermediate coating solution was applied to the fluidized particles for a period of about one hour. The resulting coated particles being of uniform size and being dry and free flowing.

The outer coating solution was prepared by dissolving 17.37 lbs of sodium octyl sulfonate in 3.50 lbs of soft water. The outer coating solution was sprayed on the fluidized particles in the same manner as the intermediate coating. The outer coating solution was applied to the fluidized particles for about one hour. The resulting particles being of substantially uniform size and being dry and free flowing.

After addition of the outer coating, the bed temperature was allowed to rise to about 180° F. to assure that no free moisture was left in the resulting encapsulate. The encapsulates were then allowed to cool to less than 110° F. and discharged from the system.

EXAMPLE 22

TABLE 22

| Raw Material | Parts to Net 100 Parts |
|---|---|
| Sodium Dichloroisocyanurate Dihydrate[1] | 50.31 |
| Sodium Chloride | 33.60 |
| Water, Soft | 99.88 |
| Sodium Octyl Sulfonate | 48.97 |
| Water, Soft | 48.97 |
| Water, Evaporated[2] | −181.73 |
| Total | 100.00 |

[1]Commercially available as CDB-56 TM from Olin Chemicals, Stanford, Connecticut.
[2]Water added to initial formulation, but not present in the final. Dried product due to evaporation.

35 lbs of encapsulated active chlorine compound comprising the ingredients listed above were prepared according to the following procedure: 17.6 lbs of granular dichloroisocyanurate dihydrate (CDB-56 TM from Olin Corp.) with particle size of about 10 to 60 U.S. mesh were placed onto the distributor plate of the cylindrical coating tower. The particles were fluidized and suspended by an upwardly moving air stream supplied by the blower. The temperature of the bed was maintained between 43° C. and 83° C. throughout the process.

The intermediate inorganic coating solution was prepared by dissolving 11.76 lbs sodium chloride in 34.96 lbs of soft water. The intermediate coating solution was sprayed on the fluidized particles through a nozzle appropriately adjusted to height. The intermediate coating solution was applied to the fluidized particles for a period of about one hour. The resulting coated particles being of uniform size and being dry and free flowing.

The outer coating solution was prepared by dissolving 17.14 lbs of sodium octyl sulfonate in 17.14 lbs of soft water. The outer coating solution was sprayed on the fluidized particles in the same manner as the intermediate coating. The outer coating solution was applied to the fluidized particles for about one hour. The resulting particles being of substantially uniform size and being dry and free flowing.

After addition of the outer coating, the bed temperature was allowed to rise to about 180° F. to assure that no free moisture was left in the resulting encapsulate. The encapsulates were then allowed to cool to less than 110° F. and discharged from the system.

EXAMPLE 23

TABLE 23

| Raw Material | Parts to Net 100 Parts |
|---|---|
| Sodium Dichloroisocyanurate Dihydrate[1] | 50.32 |
| Sodium Sulfonate | 33.61 |
| Water, Soft | 99.89 |
| Sodium Octyl Sulfonate | 48.97 |
| Water, Soft | 48.97 |
| Water, Evaporated[2] | −181.76 |
| Total | 100.00 |

[1]Commercially available as CDB-56 TM from Olin Chemicals, Stanford, Connecticut.
[2]Water added to initial formulation, but not present in the final. Dried product due to evaporation.

900 lbs of encapsulated active chlorine compound comprising the ingredients listed above were prepared according to the following procedure: 452.88 lbs of granular dichloroisocyanurate dihydrate (CDB-56 TM from Olin Corp.) with particle size of about 10 to 60 U.S. mesh were placed onto the distributor plate of the cylindrical coating tower. The particles were fluidized and suspended by an upwardly moving air stream supplied by the blower. The temperature of the bed was maintained between 43° C. and 83° C. throughout the process.

The intermediate inorganic coating solution was prepared by dissolving 302.49 lbs sodium sulfate in 899.01 lbs of soft water. The intermediate coating solution was sprayed on the fluidized particles through a nozzle appropriately adjusted to height. The intermediate coating solution was applied to the fluidized particles for a period of about one hour. The resulting coated particles being of uniform size and being dry and free flowing.

The outer coating solution was prepared by dissolving 440.73 lbs of sodium octyl sulfonate in 440.73 lbs of soft water. The outer coating solution was sprayed on the fluidized particles in the same manner as the intermediate coating. the outer coating solution was applied to the fluidized particles for about one hour. The resulting particles being of substantially uniform size and being dry and free flowing.

After addition of the outer coating, the bed temperature was allowed to rise to about 180° F. to assure that no free moisture was left in the resulting encapsulate. The encapsulates were then allowed to cool to less than 110° F. and discharged from the system.

The invention has been described with reference to various specific and preferred embodiments and techniques. However, it should be understood that many variations and embodiments of the invention may be made without departing from the spirit and scope of the invention.

We claim:

1. A solid chlorinated rinse aid concentrate, suitable for dispensing into an aqueous rinse composition useful for rinsing ware after a wash cycle, said concentrate comprising:

(a) a continuous organic solid phase comprising about 10–90 wt-% of a low foaming polyoxyalkylene surfactant; and (b) about 5–60 wt-%, each percentage based on the rinse concentrate, of an encapsulate dispersed throughout said organic solid phase comprising an encapsulate layer and a core comprising an active chlorine compound, wherein said encapsulate is substantially stable in the presence of said polyoxyalkylene surfactant providing stain control or sanitization with an effective rinsing-sheeting action.

2. The concentrate of claim 1 wherein said polyoxyalkylene surfactant is a block copolymer that comprises a block of ethylene oxide or propylene oxide.

3. The concentrate of claim 2 wherein said surfactant comprises a polyoxyethylene-polyoxypropylene-polyoxyethylene block copolymer or a polyoxypropylene-polyoxyethylene-polyoxypropylene block copolymer.

4. The concentrate of claim 2 wherein the said surfactant comprises a $C_{3-30}$ alkyl—0—$(EO)_x$—$(PO)_y$ wherein x is to 200 and y is 1 to 200.

5. The concentration of claim 2 wherein said surfactant comprises a benzyl ether of an polyethoxylated $C_{12-14}$ linear alcohol.

6. The concentrate of claim 1 wherein the hydrolysis constant of the active chlorine compound is at least $10^{-4}$.

7. The concentrate of claim 6 wherein said active chlorine compound comprises a chlorinated isocyanurate compound.

8. The concentrate of claim 7 wherein said chlorinated isocyanurate compound comprises sodium dichloroisocyanurate dihydrate.

9. The concentrate of claim 1 wherein said encapsulate comprises a core of active chlorine, and an outer layer comprising an inorganic compound selected from the group consisting of a filler compound, a builder compound or mixtures thereof.

10. The concentrate of claim 1 wherein there is about 5 to 5,000 grams of the solid rinse aid in a regular geometric form.

11. The concentrate of claim 10 wherein the rinse aid is packaged in a container comprising a plastic material, a metal or metal foil, a paperboard material, or a laminate therreof.

12. The concentrate of claim 1, further comprising about 0.1–5.0 wt-% of a sequestering agent.

13. The concentration of claim 12 wherein the sequestering agent comprises a phosphonic acid or salt thereof.

14. The concentrate of claim 13 wherein the phosphonic acid comprises hydroxyethylidene-1,1-diphosphonic acid.

15. The concentrate of claim 1, further comprising about 0.01–10 wt-% of a defoaming agent.

16. The concentration of claim 15 wherein the defoamer comprises a silicone defoamer or a polyoxyalkylene defoamer.

17. The concentrate of claim 1 wherein the encapsulate comprises a core of active chlorine, having a first intermediate layer comprising an inorganic compound and an exterior layer comprising an anionic rinse aid or a cellulose derivative.

18. A solid, cast, chlorinated rinse aid concentrate, suitable for dispensing into an aqueous rinse composition useful for rinsing ware after a wash cycle, said concentrate comprising:

(a) about 20–70 wt-% of a low foaming polyoxyalkylene surfactant; and (b) about 10–50 wt-%, each percentage based on the rinse concentrate, of an encapsulated source of active chlorine; and (c) about 1–30 wt-% of a diluent organic carrier;

wherein said encapsulate is substantially stable in the presence of said organic carrier and polyoxyalkylene surfactant providing stain control or sanitization with an effective rinsing-sheeting action.

19. The concentrate of claim 18 wherein the concentrate additionally comprises 0.1 to 20 wt-% hydrotrope.

20. The concentrate of claim 19 wherein the hydrotrope comprises an aromatic sulfonic acid, a dialkyl sulfosuccinic acid or salt thereof.

21. The concentrate of claim 19 wherein said polyoxyalkylene surfactant is a block copolymer that comprises a block of ethylene oxide or propylene oxide.

22. The concentrate of claim 21 wherein said surfactant comprises a polyoxyethylene-polyoxypropylene-polyoxyethylene block copolymer or a polyoxypropylene-polyoxyethylene-polyoxypropylene block copolymer.

23. The concentrate of claim 21 wherein the rinse aid comprises $C_{3-30}$ alkyl—0—$(EO)_x$—$(PO)_y$ wherein x is 1 to 200 and y is 1 to 200.

24. The concentrate of claim 21 wherein the surfactant comprises a benzyl ether of a polyethoxylated $C_{12-14}$ alcohol.

25. The concentrate of claim 19 wherein said diluent carrier comprises a polymeric compound.

26. The concentrate of claim 25 wherein said polymeric compound comprises a polyalkylene glycol compound having a molecular weight of 1,000 to 20,000.

27. The concentrate of claim 26 wherein said polyalkylene glycol comprises a polyethylene glycol.

28. The concentrate of claim 19 wherein the active chlorine compound has a hydrolysis constant of at least about $10^{-4}$.

29. The concentrate of claim 28 wherein said active chlorine compound comprises a chlorinated isocyanurate compound.

30. The concentrate of claim 29 wherein said chlorinated isocyanurate compound comprises sodium dichloroisocyanurate dihydrate.

31. The concentrate of claim 19 wherein said encapsulate comprises an inorganic compound selected from the group consisting of a filler compound, a builder compound or mixtures thereof.

32. The concentrate of claim 19 wherein there is about 50 to 5,000 grams of the solid rinse aid concentrate in a regular geometric form.

33. The concentrate of claim 32 wherein the solid rinse aid is packaged in a container comprising a plastic material, a metal or metal foil, a paperboard material or laminate thereof.

34. The concentrate of claim 19 further comprising about 0.1–5.0 wt-% of a sequestering agent.

35. The concentrate of claim 34 wherein the sequestering agent comprises a phosphonic acid or salt thereof.

36. The concentrate of claim 35 wherein the phosphonic acid comprises hydroxyethylidene-1,1-diphosphonic acid.

37. The concentrate of claim 19 further comprising about 0.01–1 wt-% of a defoaming agent.

38. The concentrate of claim 37 wherein the defoamer comprises a silicone defoamer or a polyoxyalkylene defoamer.

39. The concentrate of claim 19 wherein the encapsulate comprises a core of active chlorine, having a first intermediate layer comprising an inorganic compound and an exterior layer comprising an anionic rinse aid or a cellulose ether derivative.

40. The concentrate of claim 39 wherein the anionic rinse aid comprises a $C_{3-18}$ alkyl sulfonic acid or salt thereof.

41. A solid, cast, chlorinated rinse aid concentrate, suitable for dispensing into an aqueous rinse composition useful for rinsing ware after a wash cycle, said concentrate comprising:

(a) about 20–70 wt-% of a low foaming polyoxyalkylene surfactant; and (b) about 10–50 wt-% of an encapsulate; and (c) about 0.1 to 20 wt-% of a hydrotrope solubilizer for the surfactant;

(d) about 0.1 to 30 wt-% of a polyalkylene glycol carrier; and (e) about 0.1 to 10 wt-%, each percentage based on the concentrate of a sequestrant, wherein said encapsulate comprises an encapsulate layer and a core comprising an active chlorine compound and said encapsulate is substantially stable in the presence of said surfactant and carrier providing stain control or sanitization with an effective rinsing-sheeting action.

42. The concentrate of claim 41 wherein said low foaming polyoxyalkylene surfactant is a block copolymer that comprises a block of ethylene oxide or propylene oxide.

43. The concentrate of claim 42 wherein said surfactant comprises a polyoxyethylene-polyoxypropylene-polyoxyethylene block copolymer or a polyoxypropylene-polyoxyethylene-polyoxypropylene block copolymer.

44. The concentrate of claim 42 wherein the said rinse aid comprises a $C_{3-30}$ alkyl—0—$(EO)_x$—$(PO)_y$ wherein x is 10 to 200 and y is 10 to 200.

45. The concentrate of claim 41 wherein the hydrotrope solubilizer comprises an aromatic sulfonate.

46. The concentrate of claim 45 wherein the aromatic sulfonate comprises a xylene sulfonate.

47. The concentrate of claim 41 wherein the sequestrant comprises an organic phosphonate.

48. The concentrate of claim 47 wherein the sequestrant comprises an organic polyphosphonate.

49. The concentrate of claim 41 wherein the polyalkylene glycol carrier comprises a polyethylene glycol having a molecular weight of 1,000 to 20,000.

50. The concentrate of claim 41 wherein the encapsulate comprises a source of active chlorine having an intermediate coating comprising an inorganic salt and an exterior coating comprising a cellulose derivative or an organic anionic rinse aid.

51. The concentrate of claim 41 wherein the inorganic salt comprises sodium sulfate, sodium phosphate, sodium tripolyphosphate or mixtures thereof.

52. The concentrate of claim 50 wherein the anionic rinse aid comprises an $C_{5-18}$ alkyl sulfonate.

* * * * *

UNITED STATES PATENT AND TRADEMARK OFFICE

CERTIFICATE OF CORRECTION

PATENT NO. : 5,358,653

DATED : October 25, 1994

INVENTOR(S) : Elizabeth J. Gladfelter et al.

It is certified that error appears in the above-identified patent and that said Letters Patent is hereby corrected as shown below:

In Column 24, line 29, after the word "surfactant", insert -- said rinse composition --.

In Column 24, line 42, "concentration" should read -- concentrate --.

In Column 25, line 9, "concentration" should read -- concentrate --.

In Column 25, line 15, "rinse aid" should read -- detergent --.

In Column 25, line 29, after the word "surfactant", insert --, said rinse composition --.

In Column 26, line 26, "rinse aid" should read -- detergent --.

In Column 26, line 30, "rinse aid" should read -- detergent --.

In Column 26, line 48, after the word "carrier", insert -- , said rinse composition --.

UNITED STATES PATENT AND TRADEMARK OFFICE

CERTIFICATE OF CORRECTION

PATENT NO. : 5,358,653

DATED : October 25, 1994

INVENTOR(S) : Elizabeth J. Gladfelter et al.

It is certified that error appears in the above-identified patent and that said Letters Patent is hereby corrected as shown below:

In Column 28, line 2, "rinse aid" should read -- detergent --.

In Column 28, line 7, "rinse aid" should read -- detergent --.

Signed and Sealed this

Seventh Day of February, 1995

*Attest:*

*Attesting Officer*

BRUCE LEHMAN

*Commissioner of Patents and Trademarks*